US006872875B2

(12) United States Patent
Hollander

(10) Patent No.: US 6,872,875 B2
(45) Date of Patent: Mar. 29, 2005

(54) MUTE FOR STRINGED INSTRUMENT

(76) Inventor: Jane F. Hollander, 2924 N. Shepard Ave., Milwaukee, WI (US) 53211-3434

( * ) Notice: Subject to any disclaimer, the term of this patent is extended or adjusted under 35 U.S.C. 154(b) by 259 days.

(21) Appl. No.: 10/167,560

(22) Filed: Jun. 12, 2002

(65) Prior Publication Data

US 2003/0056635 A1 Mar. 27, 2003

Related U.S. Application Data

(60) Provisional application No. 60/297,691, filed on Jun. 12, 2001.

(51) Int. Cl.[7] ..... G10D 1/10

(52) U.S. Cl. ..... 84/273; 81/310

(58) Field of Search ..... 84/273, 310, 290, 84/269; D17/20

(56) References Cited

U.S. PATENT DOCUMENTS 4,773,296 A * 9/1988 Bech ..... 84/310
D441,392 S * 5/2001 Naydan ..... D17/20

* cited by examiner

*Primary Examiner*—Kimberly Lockett
(74) *Attorney, Agent, or Firm*—Michael Best & Friedrich LLP

(57) ABSTRACT

A mute for a stringed instrument which includes a character or caricature.

15 Claims, 3 Drawing Sheets

MUTE FOR STRINGED INSTRUMENT

This application claims the benefit of Provisional Application No. 60/297,691, filed Jun. 12, 2001.

FIELD OF THE INVENTION

The invention relates to a mute for a stringed instrument, and more particularly, to a mute for a stringed instrument including a character such as a person, animal, place or thing and designed specifically for young players.

BACKGROUND OF THE INVENTION

Mutes of the violin family are used to change the timbre and reduce the loudness of the instrument. Solo repertoire, chamber music and orchestral music all require the muting of stringed instruments from time to time. Mutes are small devices which fit onto the bridge of the stringed instrument and are either permanently affixed or removable.

In recent years there has been an emphasis on early training and development of the young string player, resulting in a significant population of young musicians. Players may begin training as early as three years of age and continue their lessons throughout their elementary and high school years.

Mutes available to string players include several varieties. They can be fashioned of wood, hard leather, plastic, metal, rubber, or a combination of materials. When in playing position they all perform the same function and produce a relatively similar result. Whether they are permanent or removable, and regardless of the materials used, all manifest a utilitarian style.

SUMMARY OF THE INVENTION

The invention provides a mute for a stringed instrument that is particularly adapted for the young string player. The mute of the present invention performs the functions of a mute when in the playing position, however, the mute is also configured to be a character such as of a person, animal, place or thing intended to delight the young string player. Such a mute is a whimsical device to entice and excite a young player without offending the serious musician. The mute softens the sound of any of the violin family instruments while appealing to younger players who take delight in seeing the friendly face of a mouse or other person, animal, place or thing atop the bridge of their instrument.

Features and advantages of the invention will become apparent to those of ordinary skill in the art upon review of the following detailed description and drawings.

Figure 3:
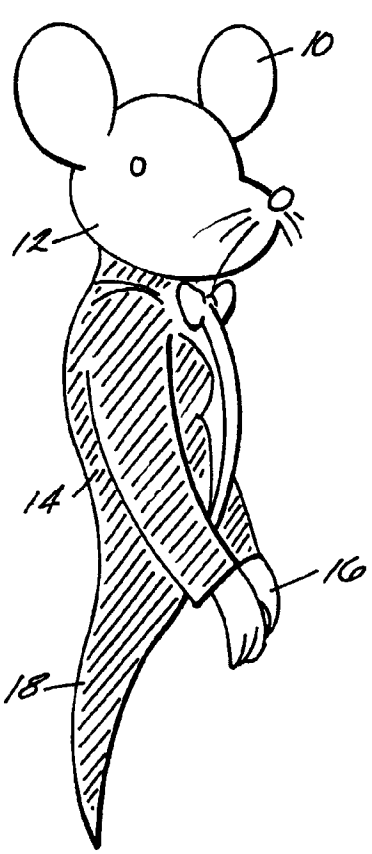
FIG. 3 is a side view of the mute of FIG. 1.

Before one embodiment of the invention is explained in detail, it is to be understood that the invention is not limited in its application to the details of construction and the arrangement of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DETAILED DESCRIPTION OF THE PREFERRED EMBODIMENT

Referring to the drawing, various embodiments of the mute of the present invention are shown. The mutes are designed to include a character or caricature and are primarily for the young stringed instrument player. The stringed instruments for which this mute is suited are the violin, the viola, the cello and the bass. The mute is used to reduce the sound of the instrument and is employed such as in orchestral, chamber music, or solo playing.

Figure 2:
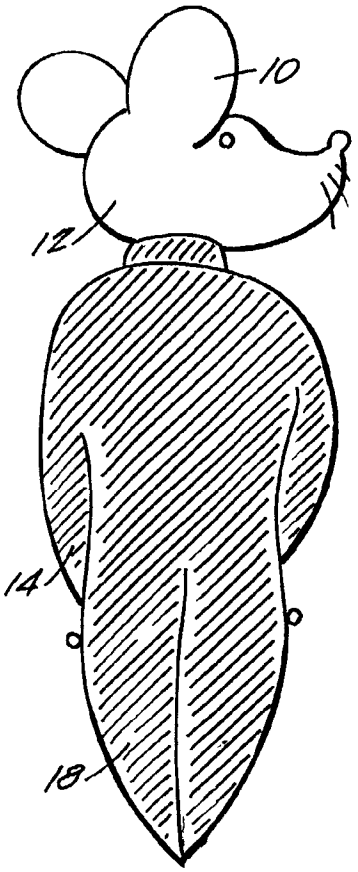
FIG. 2 is a back view of the mute of FIG. 1.
Figure 1:
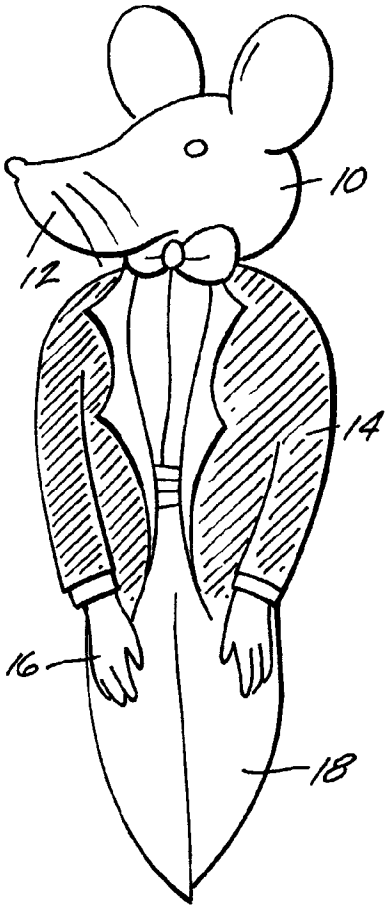
FIG. 1 is a front view of a first embodiment of the mute of the present invention including a caricature of a mouse in a tuxedo.

Specifically, the mute 10 of the first embodiment shown in FIGS. 1–3 includes the head 12 and torso 14 of a mouse figure, dressed in concert attire. In use, the mute 10 sits atop the bridge of any of the violin family instruments. Its use allows players to play "quiet as a mouse". In use, the mouse's front paws 16 extend over the front of the bridge of the stringed instrument while the tails of its tuxedo 18 extend over the rear of the bridge, reducing the bridge's capacity for full vibration thus reducing sound. The stringed instrument's bridge is straddled by the mouse's paws 16 in the front and the tails of the mouse tuxedo 14 in back of the bridge.

The mute 10 of the present invention is affixed to the instrument by placing it sideways between the middle two strings of the instrument, between the bridge and the tailpiece. It is then turned one quarter rotation to allow it to face the player and engage the two middle strings in the slotted openings between the arm and torso on each side of the mouse. When the mute 10 is in a playing position, its front paws straddle the bridge between the two middle strings. The tuxedo tails 14 abut the back of the bridge either straddling the two middle strings or fitting between the two middle strings.

When in its rest position, the mute 10 is lifted slightly to remove the paws from the bridge and the mute 10 is then slid down to the tailpiece where it rests until needed. It is glided back up to the bridge without removal from the strings, for reengagement in its playing position.

Figure 6:
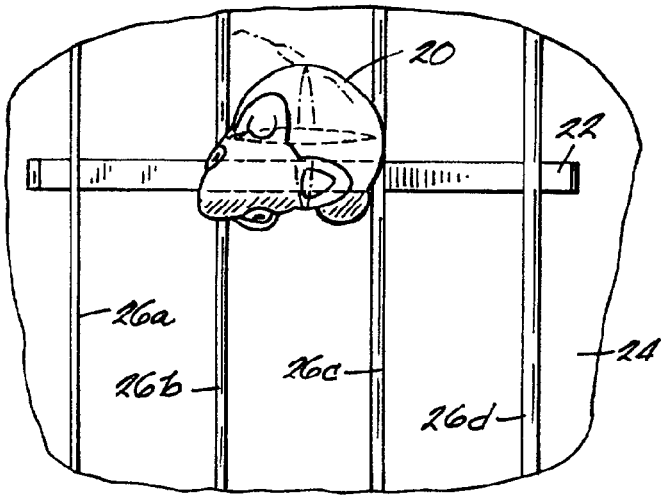
FIG. 6 is a top view of the mute of FIG. 4 in the playing position.
Figure 4:
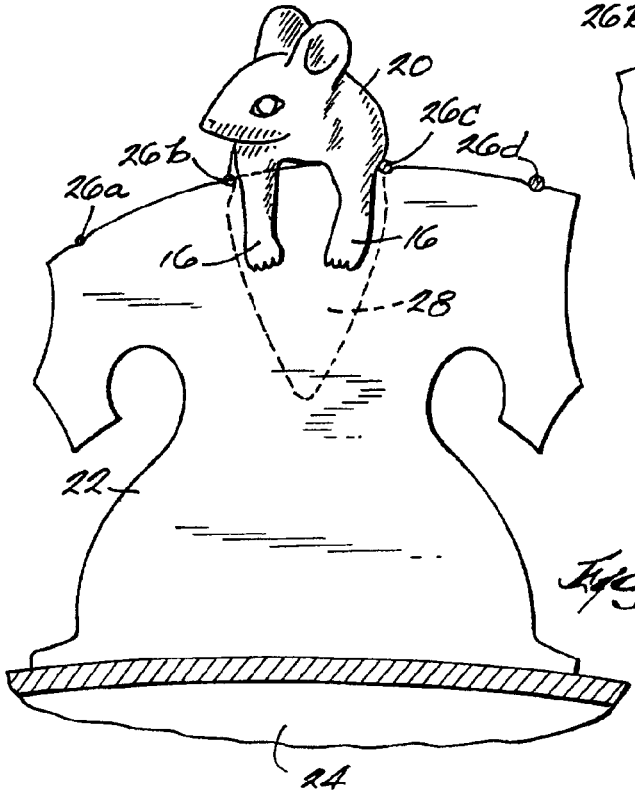
FIG. 4 is a perspective view of another embodiment of the mute in the playing position.

FIGS. 4 and 6 shows a second embodiment of a mute 20 in the playing position on bridge 22 on a stringed instrument 24 including strings 26*a–d*. The character in this second embodiment is also a mouse with paws 16 and a body portion 28. The phantom lines in FIG. 6 illustrate the rotation of the mute 20 into the playing position.

Figure 5:
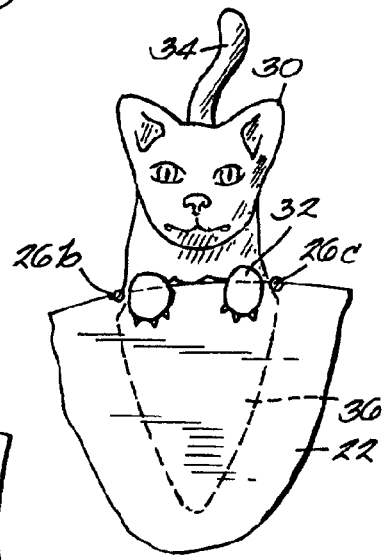
FIG. 5 is a perspective view of another embodiment of the mute in the playing position.

FIG. 5 shows a third embodiment of a mute 30 in the playing position on the bridge 22 of the stringed instrument. The caricature of this mute is that of a cat with paws 32, a tail 34 and a body portion 36.

Figure 7:
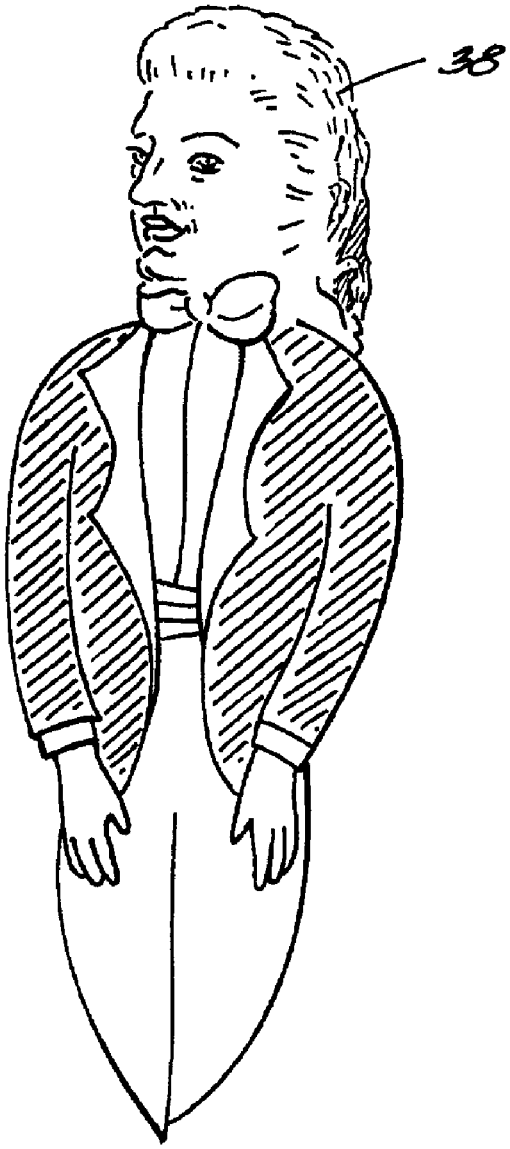
FIG. 7 is a front view of a third embodiment of the present invention including a caricature of Mozart.

FIG. 7 shows a fourth embodiment of mute 38 which includes a caricature of Mozart.

The characters and caricatures shown herein include an example of animals (mouse and cat) and a person (Mozart). However, it should be noted that the invention is not limited to these two specific examples. For example, the mute could include other animals or other persons. Further, the character could be of a place or location such as Carnegie Hall or a thing such as a treble clef.

The mute of the present invention is preferably fabricated of hard plastic or rubber, however, other materials can also be utilized.

What is claimed is:

1. A mute for a stringed instrument having a bridge and strings, said mute comprising:

a character; and a body portion connected to the character and having a slotted opening which surrounds a string, the mute being slidable along the string between a first position atop the bridge to function as a muting position and a second position removed from the bridge to function as a storage position.

2. The mute of claim 1 wherein the character is intended to be whimsical and provide entertainment to a younger player of the stringed instrument.

3. The mute of claim 1 wherein the body portion has a second slotted opening and wherein a second string is positionable in the second slotted opening.

4. The mute of claim 1 wherein the character and the body portion are the representation of a cat dressed in a tuxedo with paws that hang over one side or the bridge and tails of the tuxedo that hang over the other side of the bridge when the mute is in the first position.

5. The mute of claim 1 wherein the character and the body portion are the representation of a mouse dressed in a tuxedo with paws that hang over one side of the bridge and tails of the tuxedo that hang over the other side of the bridge when the mute is in the muting position.

6. The mute of claim 1 wherein the character and the body portion are the representation of Mozart dressed in a tuxedo with arms that hang over one side of the bridge and tails of the tuxedo that hang over the other side of the bridge when the mute is in the muting position.

7. A mute for a stringed instrument having a bridge and strings, the mute comprising:

a character; and a body portion integral with the character and removably fastenable to the bridge, wherein the mute has a muting position and a storage position, in the muting position the mute is slidable along the strings without removal from the instrument to the storage position, and slidable along the strings from the storage position to the muting position without removal from the instrument.

8. The mute of claim 7 where the character is intended to be whimsical and provide delight to a younger player of the stringed instrument.

9. The mute of claim 7 wherein the body portion has a slotted opening and where at least one string is positionable in the slotted opening.

10. The mute of claim 7 wherein the character and the body portion are the representation of a cat dressed in a tuxedo with paws that hang over side of the bridge and tails of the tuxedo that hang over the other side of the bridge when the mute is in the muting position.

11. The mute of claim 7 wherein the character and the body portion are the representation of a mouse dressed in a tuxedo with paws that hang over one side of the bridge and tails of the tuxedo that hang over the other side of the bridge when the mute is in the muting position.

12. The mute of claim 7 wherein the character and the body portion are the representation of Mozart dressed in a tuxedo with arms that hang over one side of the bridge and tails of the tuxedo that hang over the other side of the bridge when the mute is in the muting position.

13. A mute for a stringed instrument in the violin family having a bridge and strings, said mute comprising:

a body adapted to represent the likeness of a mouse and being slidable along the strings between a muting position and a storage position.

14. The mute of claim 13 wherein the body portion has a slotted opening and wherein at least one string is positionable in the slotted opening.

15. The mute of claim 14 wherein the mute has a play position and a rest position, in the play position the mute is slidable along the strings without complete removal to the rest position, and slidable along the strings from the rest position to the play position without complete removal.

* * * * *